US006537134B2

(12) United States Patent
Newell

(10) Patent No.: US 6,537,134 B2
(45) Date of Patent: Mar. 25, 2003

(54) POLISHING PAD COMPRISING A FILLED TRANSLUCENT REGION

(75) Inventor: Kelly J. Newell, St. Charles, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 09/682,662

(22) Filed: Oct. 3, 2001

(65) Prior Publication Data

US 2002/0049033 A1 Apr. 25, 2002

Related U.S. Application Data

(60) Provisional application No. 60/238,862, filed on Oct. 6, 2000.

(51) Int. Cl.[7] ..... B24D 11/00

(52) U.S. Cl. ..... 451/6; 451/41; 451/526

(58) Field of Search ..... 451/526, 41, 6, 451/8, 527, 528, 533; 525/123, 128, 455, 524, 589, 590; 523/149

(56) References Cited

U.S. PATENT DOCUMENTS

| | | | | |
|---|---|---|---|---|
| 2,838,889 A | | 6/1958 | Lankes | |
| 4,512,847 A | | 4/1985 | Brunsch et al. | |
| 4,532,738 A | | 8/1985 | Sippel | |
| 4,693,038 A | | 9/1987 | Vetter | |
| 4,919,992 A | * | 4/1990 | Blundell et al. | 264/288.8 |
| 5,023,188 A | | 6/1991 | Tanaka | |
| 5,036,015 A | | 7/1991 | Sandhu et al. | |
| 5,081,796 A | | 1/1992 | Schultz | |
| 5,137,540 A | | 8/1992 | Halpert et al. | |
| 5,196,353 A | | 3/1993 | Sandhu et al. | |
| 5,240,552 A | | 8/1993 | Yu et al. | |
| 5,337,015 A | | 8/1994 | Lustig et al. | |
| 5,375,064 A | | 12/1994 | Bollinger | |
| 5,411,430 A | * | 5/1995 | Nishimura et al. | 451/1 |
| 5,413,941 A | | 5/1995 | Koos et al. | |
| 5,433,650 A | | 7/1995 | Winebarger | |
| 5,433,651 A | | 7/1995 | Lustig et al. | |
| 5,486,129 A | | 1/1996 | Sandhu et al. | |
| 5,489,233 A | | 2/1996 | Cook et al. | |
| 5,499,733 A | | 3/1996 | Litvak | |
| 5,533,923 A | | 7/1996 | Shamouilian et al. | |
| 5,605,760 A | | 2/1997 | Roberts | |
| 5,609,511 A | | 3/1997 | Moriyama et al. | |
| 5,643,046 A | | 7/1997 | Katakabe et al. | |
| 5,658,183 A | | 8/1997 | Sandhu et al. | |
| 5,672,091 A | | 9/1997 | Takahashi et al. | |
| 5,730,642 A | | 3/1998 | Sandhu et al. | |
| 5,767,218 A | * | 6/1998 | Becker et al. | 528/25 |
| 5,838,447 A | | 11/1998 | Hiyama et al. | |
| 5,872,633 A | | 2/1999 | Holzapfel et al. | |
| 5,893,796 A | | 4/1999 | Birang et al. | |
| 5,949,927 A | | 9/1999 | Tang | |
| 5,964,643 A | | 10/1999 | Birang et al. | |
| 5,985,679 A | | 11/1999 | Berman | |
| 6,017,265 A | | 1/2000 | Cook et al. | |
| 6,022,268 A | | 2/2000 | Roberts et al. | |
| 6,045,439 A | | 4/2000 | Birang et al. | |
| 6,068,540 A | | 5/2000 | Dickenscheid et al. | |
| 6,071,177 A | | 6/2000 | Lin et al. | |
| 6,074,287 A | | 6/2000 | Miyaji et al. | |
| 6,146,242 A | | 11/2000 | Treur et al. | |
| 6,146,248 A | | 11/2000 | Jairath et al. | |
| 6,159,073 A | | 12/2000 | Wiswesser et al. | |
| 6,171,181 B1 | | 1/2001 | Roberts et al. | |
| 6,190,234 B1 | | 2/2001 | Swedek et al. | |
| 6,213,845 B1 | | 4/2001 | Elledge | |
| 6,217,434 B1 | | 4/2001 | Roberts et al. | |
| 6,224,460 B1 | | 5/2001 | Dunton et al. | |
| 6,010,538 A1 | | 1/2002 | Sun et al. | |
| 6,337,101 B1 | * | 1/2002 | Gozdz | 427/340 |

FOREIGN PATENT DOCUMENTS

| | | |
|---|---|---|
| EP | 0 893 203 A | 1/1999 |
| JP | 56-024934 A | 3/1981 |
| JP | 61-270060 A | 11/1986 |
| JP | 5-309558 | 11/1993 |
| JP | 7-052032 | 2/1995 |
| WO | WO 94/04599 | 3/1994 |
| WO | WO 97/06921 | 2/1997 |

* cited by examiner

*Primary Examiner*—Joseph J. Hail, III
*Assistant Examiner*—Hadi Shakeri

(57) ABSTRACT

A polishing pad comprising a region that is at least translucent, wherein the translucent region comprises a matrix polymer and a filler, is provided herein. Also provided is a method for producing a polishing pad comprising a region that is at least translucent, which method comprises (a) providing a porous matrix polymer, (b) filling at least a portion of the pores of the matrix polymer with a filler to provide a region that is at least translucent, and (c) forming a polishing pad comprising the region that is translucent. A method of polishing a substrate, particularly a semiconductor substrate, comprising the use of the polishing pad of the present invention also is provided herein.

36 Claims, No Drawings

POLISHING PAD COMPRISING A FILLED TRANSLUCENT REGION

TECHNICAL FIELD

This invention pertains to a polishing pad comprising a region that is at least translucent to light, and a method of producing and using such a polishing pad.

BACKGROUND OF THE INVENTION

In polishing the surface of a substrate, it is often advantageous to monitor the polishing process in situ. One method of monitoring the polishing process in situ involves the use of a polishing pad having an aperture or window. The aperture or window provides a portal through which light can pass to allow the inspection of the substrate surface during the polishing process. Polishing pads having apertures and windows are known and have been used to polish substrates, such as the surface of semiconductor devices. For example, U.S. Pat. No. 5,605,760 (Roberts) provides a pad having a transparent window formed from a solid, uniform polymer, which has no intrinsic ability to absorb or transport slurry. U.S. Pat. No. 5,433,651 (Lustig et al.) discloses a polishing pad wherein a portion of the pad has been removed to provide an aperture through which light can pass. U.S. Pat. No. 5,893,796 and 5,964,643 (both by Birang et al.) disclose removing a portion of a polishing pad to provide an aperture and placing a transparent polyurethane or quartz plug in the aperture to provide a transparent window, or removing a portion of the backing of a polishing pad to provide a translucency in the pad.

Still, there remains a need for effective polishing pads having translucent regions and efficient methods for their production and use. The invention provides such a pad, as well as methods of its production and use. These and other advantages of the present invention, as well as additional inventive features, will be apparent from the description of the invention provided herein.

SUMMARY OF INVENTION

The present invention provides a polishing pad comprising a region that is at least translucent, wherein the translucent region comprises a matrix polymer and a filler. The present invention further provides a method for producing a polishing pad comprising a region that is at least translucent, which method comprises (a) providing a porous matrix polymer, (b) filling at least a portion of the pores of the matrix polymer with a filler to provide a region that is at least translucent, and (c) forming a polishing pad comprising the region that is at least translucent. A method of polishing a substrate, particularly a semiconductor substrate, comprising the use of the polishing pad of the present invention also is provided herein.

DETAILED DESCRIPTION

The polishing pad of the present invention comprises a region that is at least translucent to light, wherein the translucent region comprises a matrix polymer and a filler. The term at least translucent, as used herein, refers to the ability to transmit at least a portion of the light contacting the surface of the pad and can be used to describe slightly, partially, substantially and completely translucent or transparent materials. The translucent region of the present inventive polishing pad is preferably at least translucent to light having a wavelength of about 190–3500 nm, more preferably visible light, most preferably visible light from a laser light source, particularly as used in a polishing device to be used with the polishing pad.

The matrix polymer, typically, serves as the body of the polishing pad and can comprise any suitable polymer known in the art. Preferred matrix polymers are capable of providing a porous structure (i.e., containing a plurality of pores, voids, passages, channels, or the like, of any size or shape), either by their natural configuration or through the use of various production techniques known in the art (e.g., foaming, blowing, etc.). More preferably, the structure of the matrix polymer is such that the matrix polymer is substantially opaque in the absence of the filler; however, when combined with the filler, the matrix polymer is at least translucent. Polymers suitable for use as the matrix polymer include urethanes, acrylics, nylons, epoxies, and other suitable polymers known in the art. A preferred matrix polymer comprises, consists essentially of, or consists of, polyurethane, more preferably porous polyurethane.

The matrix polymer generally provides a polishing surface on the polishing pad, which surface contacts the surface of the substrate during polishing. The matrix polymer, therefore, preferably comprises a surface texture to facilitate the transport of slurry across the polishing surface of the pad. Preferably, the matrix polymer comprises an intrinsic surface texture that allows it to absorb and/or transport polishing slurry on its surface. The term intrinsic surface texture refers to a surface texture that arises from the nature of the composition as opposed to texture that is produced by external processes. For example, a porous polyurethane pad may have an intrinsic surface texture as a consequence of the exposed pore structure on the pad surface. In addition to, or instead of, the intrinsic surface texture, the matrix polymer can comprise a surface texture produced by external processes (i.e., extrinsic surface texture), such as are known in the art (e.g., embossing, stamping, cutting or abrading, etc.). The matrix polymer of the present invention preferably comprises sufficient intrinsic and/or extrinsic surface texture to facilitate the absorption and/or transport of slurry across the surface of the pad.

The translucent region of the polishing pad comprises the matrix polymer and a filler. The filler can be any material that is capable of being combined with the matrix polymer so as to increase the translucency of the matrix polymer. Without wishing to be bound by any particular theory, it is believed that air or gas filled pores or voids (i.e., micropores or microvoids) within the matrix polymer cause light passing through to scatter, thereby reducing the translucency of the matrix polymer or rendering the matrix polymer opaque. It is further believed that the filler reduces the light-scattering effects of the gas-filled pores or voids by replacing at least a portion of the gas or air with a filler having a refractive index more similar to the matrix polymer. As a result, the combined matrix polymer/filler has an increased light transmittance (i.e., increased translucence) and reduced optical density as compared to the matrix polymer alone. Thus, the filler preferably has a refractive index that is greater than the refractive index of the gas (e.g., air) occupying the pores of the matrix polymer, and therefore, closer to that of the matrix polymer. More preferably, the filler has a refractive index that is about the equal to the refractive index of the matrix polymer. As the translucence of the combined matrix polymer and filler depends, in part, on the relative difference between the refractive index of the matrix polymer as compared to that of the filler, the choice of filler will depend, in part, on the matrix polymer used.

The filler can comprise, consist essentially of, or consist of any suitable material. Suitable fillers include, for example, organic compounds, such as fats, oils, natural resins, etc. Other suitable fillers include synthetic polymers and resins, such as epoxy resins, thermosetting resins, UV-setting resins, photo-setting resins, and mixtures thereof. More specific examples of suitable fillers for use in conjunction with the present invention include polyesters, styrenes, acrylics, acrylates, methacrylates, polycarbonates, ethylcyanoacrylates, and derivatives and mixtures thereof. A preferred filler material comprises, consists essentially of, or consists of polyester.

Generally, the degree of translucence (i.e., the amount of light transmitted) of a given region of the matrix polymer increases as the number of pores occupied by the filler increases. However, the filler need not occupy all of the pores of a region of the matrix polymer in order to provide a translucent region. According to one aspect of the invention, the filler occupies only a portion of the pores of the translucent region of the polishing pad. For example, the filler can occupy a sufficient portion of the interior pores of a region of the matrix polymer to provide a translucent region, yet leave the surface pores of the translucent region substantially unfilled, thereby allowing the translucent region of the matrix polymer to retain its intrinsic surface texture. According to another aspect of the present invention, the filler occupies substantially all of the pores of the translucent region. According to this aspect, for example, both the interior and surface pores can be filled, thereby reducing or eliminating the intrinsic surface texture of the matrix polymer.

Although the polishing pad of the present invention can be translucent in its entirety, the polishing pad preferably comprises a substantially opaque region in addition to the translucent region. As previously mentioned, the matrix polymer is preferably substantially opaque in the absence of the filler. Thus, the substantially opaque region is generally provided by an unfilled region of the matrix polymer such that the substantially opaque region and the translucent region comprise a continuous matrix polymer. However, a substantially opaque region can be provided without a continuous matrix polymer. The translucent region can, in other words, comprise a matrix polymer that is different from the material of the substantially opaque region. For example, the translucent region comprising a matrix polymer could be inserted into or formed as part of a substantially opaque polishing pad comprising a different material. Suitable materials for forming the opaque region are generally known in the art and include commonly used polishing pad materials such as porous or non-porous polyurethane, nylon, acrylic, and the like. Also, as previously discussed with respect to the matrix polymer, the substantially opaque region of the pad preferably comprises an intrinsic surface texture and/or an extrinsic surface texture to facilitate the absorption and/or transport of slurry across the surface of the pad.

In addition to the features discussed herein, the filler and/or matrix polymer can comprise other elements, ingredients, or additives, such as backings, adhesives, abrasives, and other additives known in the art. The filler and/or matrix polymer can comprise, for example, a light absorbing or reflecting element, such as an ultra-violet or color adsorbing or reflecting material, that would enable the passage of certain wavelengths of light, while retarding or eliminating the passage of other wavelengths of light.

The present invention also provides a method for producing a polishing pad comprising a region that is at least translucent, which method comprises (a) providing a porous matrix polymer, (b) filling at least a portion of the pores of the matrix polymer with a filler to provide a region that is at least translucent, and (c) forming a polishing pad comprising the region that is at least translucent. The matrix polymer, filler, and other elements of the present inventive method are as previously described with respect to the polishing pad of the present invention. The polishing pad can be formed by any suitable technique.

The polishing pad can be formed from the matrix polymer, before or after combining with the filler, by any method known in the art. Suitable methods include casting, cutting, injection molding, or pressing the matrix polymer into the desired polishing pad shape. Other polishing pad elements also can be added to the matrix polymer before or after shaping the matrix polymer, as desired. For example, backing materials can be applied, holes can be drilled, or surface textures can be provided, by various methods generally known in the art. Preferably, a macro- or micro-texture is provided on at least a portion of the surface of the polishing pad or matrix polymer.

The pores of the matrix polymer can be filled with the filler by any method known in the art. Suitable methods include pouring a liquid filler onto the surface of the matrix polymer, or immersing the matrix polymer in a liquid filler, and allowing the filler to absorb into the matrix polymer. Pressure and/or heat can be used to assist in the absorption of the filler into the matrix polymer. Alternatively, the filler can be admixed with the matrix polymer and cast or otherwise solidified to provide a filled matrix polymer. Other methods of filling the pores of the matrix polymer with the filler are available and known to those of ordinary skill in the art.

The present invention also provides a method of polishing a substrate comprising the use of a polishing pad of the present invention. The present method of polishing a substrate can be used to polish or planarize any substrate, for example, a substrate comprising a glass, metal, metal oxide, metal composite, semiconductor base material, or mixture thereof. The substrate can comprise, consist essentially of, or consist of any suitable metal. Suitable metals include, for example, copper, aluminum, tantalum, titanium, tungsten, gold, platinum, iridium, ruthenium, and combinations (e.g., alloys or mixtures) thereof. The substrate also can comprise, consist essentially of, or consist of any suitable metal oxide. Suitable metal oxides include, for example, alumina, silica, titania, ceria, zirconia, germania, magnesia, and combinations thereof. In addition, the substrate can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The substrate also can comprise, consist essentially of, or consist of any suitable semiconductor base material. Suitable semiconductor base materials include single-crystal silicon, poly-crystalline silicon, amorphous silicon, silicon-on-insulator, and compound semiconductor materials such as gallium arsenide and indium phosphide.

The present inventive method is useful in the planarizing or polishing of many hardened workpieces, such as memory or rigid disks, metals (e.g., noble metals), ILD layers, micro-electro-mechanical systems, ferroelectrics, magnetic heads, polymeric films, and low and high dielectric constant films. The term memory or rigid disk refers to any magnetic disk, hard disk, rigid disk, or memory disk for retaining information in electromagnetic form. Memory or rigid disks typically have a surface that comprises nickel-phosphorus, but the surface can comprise any other suitable material.

The present inventive method is especially useful in polishing or planarizing a semiconductor device, for example, semiconductor devices having device feature geometries of about 0.25 $\mu$m or smaller (e.g., 0.18 $\mu$m or smaller). The term "device feature" as used herein refers to a single-function component, such as a transistor, resistor, capacitor, integrated circuit, or the like. The present method can be used to polish or planarize the surface of a semiconductor device, for example, in the formation of isolation structures by shallow trench isolation methods (STI polishing), during the fabrication of a semiconductor device. The present method also can be used to polish the dielectric or metal layers (i.e. metal interconnects) of a semiconductor device in the formation of an inter-layer dielectric (ILD polishing).

The present inventive method of polishing a substrate can further comprise passing light through the translucent region of the polishing pad and onto a surface of the substrate, for example, during the polishing or planarizing of a substrate in order to inspect or monitor the polishing process. Techniques for inspecting and monitoring the polishing process by analyzing light or other radiation reflected from a surface of the substrate are known in the art. Such methods are provided, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643.

All of the references cited herein, including patents, patent applications, and publications, are hereby incorporated in their entireties by reference.

While this invention has been described with an emphasis upon preferred embodiments, those of ordinary skill in the art will appreciate that variations of the preferred embodiments can be used, and it is intended that the invention may be practiced otherwise than as specifically described herein. Accordingly, this invention includes all modifications encompassed within the spirit and scope of the invention as defined by the following claims.

What is claimed is:

1. A polishing pad comprising a region that is translucent, wherein the translucent region comprises a matrix polymer and a filler, and wherein the matrix polymer is substantially opaque in the absence of the filler and translucent when combined with the filler.

2. The polishing pad of claim 1, wherein the matrix polymer comprises pores.

3. The polishing pad of claim 2, wherein the matrix polymer is polyurethane.

4. The polishing pad of claim 3, wherein the filler has about the same refractive index as the matrix polymer.

5. The polishing pad of claim 3, wherein the filler comprises an organic compound.

6. The polishing pad of claim 3, wherein the filler is selected from the group consisting of epoxy resins, thermosetting resins, UV-setting resins, photo-setting resins, and mixtures thereof.

7. The polishing pad of claim 3, wherein the filler is selected from the group consisting of polyester, styrene, acrylic, acrylate, methacrylate, polycarbonate, ethylcyanoacrylate, and mixtures thereof.

8. The polishing pad of claim 7, wherein the filler is polyester.

9. The polishing pad of claim 2, wherein the filler occupies only a portion of the pores of the translucent region.

10. The polishing pad of claim 9, wherein the translucent region has an intrinsic surface texture.

11. The polishing pad of claim 2, wherein the filler occupies substantially all of the pores of the translucent region.

12. The polishing pad of claim 1, further comprising a substantially opaque region.

13. The polishing pad of claim 12, wherein the substantially opaque region is porous.

14. The polishing pad of claim 13, wherein the substantially opaque region has an intrinsic surface texture.

15. The polishing pad of claim 12, wherein the substantially opaque region and the translucent region comprise a continuous matrix polymer.

16. The polishing pad of claim 15, wherein the pad comprises a surface and at least a portion of the surface of the pad comprises an extrinsically produced surface texture.

17. The polishing pad of claim 1, wherein the translucent region is translucent to light having a wavelength of about 190–3500 nm.

18. A method for producing a polishing pad comprising a region that is translucent, which method comprises (a) providing a porous matrix polymer, (b) filling at least a portion of the pores of a region of the matrix polymer with a filler to provide a region that is translucent, and (c) forming a polishing pad comprising the region that is translucent, wherein the matrix polymer is substantially opaque in the absence of the filler and translucent when combined with the filler.

19. The method of claim 18, wherein the matrix polymer is polyurethane.

20. The method of claim 19, wherein the filler has about the same refractive index as the matrix polymer.

21. The method of claim 19, wherein the filler comprises an organic compound.

22. The method of claim 19, wherein the filler is selected from the group consisting of epoxy resins, thermosetting resins, UV-setting resins, photo-setting resins, and mixtures thereof.

23. The method of claim 19, wherein the filler is selected from the group consisting of polyester, styrene, acrylic, acrylate, methacrylate, polycarbonate, ethylcyanoacrylate, urethane, and mixtures thereof.

24. The method of claim 23, wherein the filler is polyester.

25. The method of claim 19, wherein only a portion of the pores of a region of the matrix polymer are filled to provide the translucent region.

26. The method of claim 25, wherein the translucent region comprises an intrinsic surface texture.

27. The method of claim 19, wherein substantially all of the pores of a region of the matrix polymer are filled to provide the translucent region.

28. The method of claim 18, wherein the polishing pad comprises a substantially opaque region.

29. The method of claim 28, wherein the substantially opaque region is porous.

30. The method of claim 29, wherein the substantially opaque region comprises an intrinsic surface texture.

31. The method of claim 18, further comprising providing an extrinsically produced surface texture on at least a portion of the polishing pad.

32. The method of claim 18, wherein the translucent region is translucent to light having a wavelength of about 190–3500 nm.

33. A method of polishing a substrate comprising (i) providing a polishing pad comprising a region that is translucent, wherein the translucent region comprises a matrix polymer and a filler, and wherein the matrix polymer is substantially opaque in the absence of the filler and translucent when combined with the filler, and (ii) polishing the substrate against the polishing pad.

34. The method of claim 33, wherein the substrate is a semiconductor device.

35. The method of claim 34, further comprising passing light through the translucent region of the polishing pad.

36. The method of claim 35, wherein the light is a laser light.

* * * * *